US005778581A

United States Patent [19]

Bailey

[11] Patent Number: 5,778,581

[45] Date of Patent: Jul. 14, 1998

[54] INFLATABLE DISPLAY APPARATUS

[76] Inventor: Morris W. Bailey, 409 Havenwood La. North, Fort Worth, Tex. 76112

[21] Appl. No.: 668,436

[22] Filed: Jun. 17, 1996

[51] Int. Cl.[6] ..... G09F 15/00

[52] U.S. Cl. ..... 40/610; 446/220; 40/212

[58] Field of Search ..... 40/610, 212, 214; 446/220, 222, 226, 74

[56] References Cited

U.S. PATENT DOCUMENTS

| | | | |
|---|---|---|---|
| 3,699,913 | 10/1972 | Sautbine | 446/220 |
| 4,179,832 | 12/1979 | Lemelson | 446/220 |
| 4,885,858 | 12/1989 | Strom | 40/212 |

FOREIGN PATENT DOCUMENTS

| | | | |
|---|---|---|---|
| 226119 | 7/1962 | Austria | 40/212 |

*Primary Examiner*—Cassandra Davis
*Attorney, Agent, or Firm*—Arthur F. Zobalo

[57] ABSTRACT

The apparatus has an inflatable member attached to top and bottom members. A flexible sleeve shaped display wall is attached to the top and bottom members and surrounds the inflatable member. The display sleeve has hook and loop fasteners on its outside. Flexible strips of material are attached to the top and bottom members to limit stretching of the inflatable member between the top and bottom members when inflated to prevent the display wall from being damaged when the inflatable member is inflated.

4 Claims, 3 Drawing Sheets

INFLATABLE DISPLAY APPARATUS

BACKGROUND OF THE INVENTION

1. Field of the Invention

The invention relates to an inflatable display apparatus for allowing articles to be attached thereto when inflated.

2. Description of the Prior Art

U.S. Pat. Nos. Des. 358,428; 3,670,440; 4,369,591; 4,776,121, 5,125,177 disclose various inflatable display devices.

At trade shows, etc. a need exists for a display device for displaying articles for sale and which can be easily transported, set up and disassembled.

SUMMARY OF THE INVENTION

It is an object of the invention to provide an inflatable display apparatus for displaying articles and which can be easily transported, set up and disassembled. The apparatus comprises an inflatable member attached to top and bottom members, a flexible display wall attached to the top and bottom members, an inlet for receiving gas under pressure into the cavity of the inflatable member to move the top and bottom members away from each other to move the display wall to an extended position and flexible strips of material attached to the top and bottom members to limit stretching of the inflatable member between the top and bottom members when inflated to prevent the display wall from being damaged when the inflatable member is inflated.

In the embodiment disclosed, the display wall comprises a sleeve attached to the outer sides of the top and bottom members and which surrounds the inflatable member and the flexible strips of material. The display sleeve has hook or loop fasteners formed on its outer side and the flexible strips are formed of a material with an elasticity less than that of the material of the inflatable member.

DESCRIPTION OF THE PREFERRED EMBODIMENT

Figure 2:
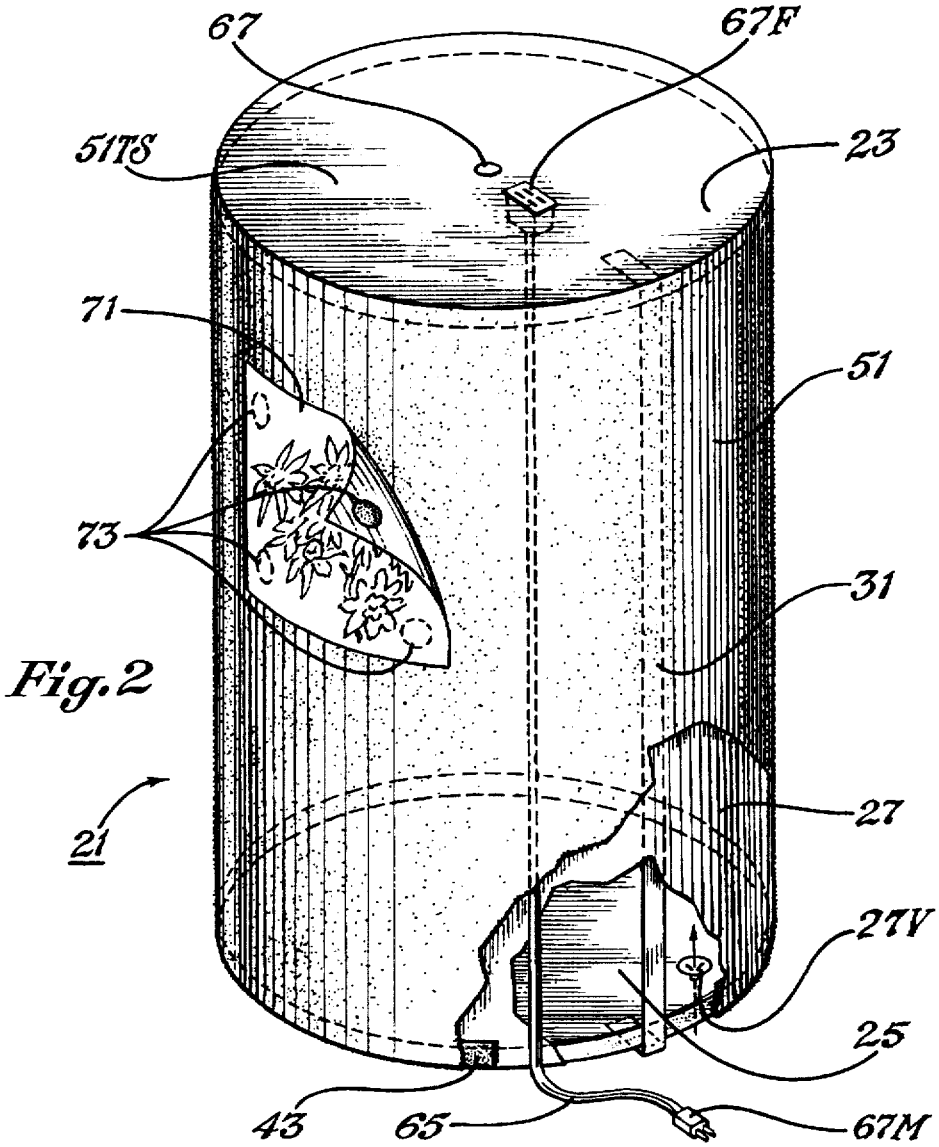
FIG. 2 is an isometric view of the inflatable apparatus of the invention in an inflated condition.

Referring now to FIGS. 1–4, the apparatus of the invention is identified by reference number 21. It comprises top and bottom members 23 and 25 formed of a light weight and relatively rigid material such as wood. The members 23 and 25 could be formed of other materials such as aluminium. Member 23 is round and has a lower end 23L, an upper end 23U and an outer cylindrical side 23S. Member 25 is round and has a lower end 25L, an upper end 25U and an outer cylindrical side 25S. A bladder 27 having an inner cavity 27C formed of a flexible and stretchable material is provided. It can be formed of different materials, however, in one embodiment it is formed of 20 mil. vinyl. The bladder 27 has a cylindrical side wall 27S and top and bottom walls 27T and 27B defining the cavity 27C. The bladder is folded at 27TF and 27BF forming two cylindrical end member reception zones 23R and 25R for receiving the end members 23 and 25 respectively. The end members 23 and 25 each has a diameter and thickness greater than that shown such that they are snugly received in zones 23R and 25R respectively with the lower surface 23L and cylindrical side wall 23S of member 23 engaging the top wall 27T and the inside cylindrical wall of folded portion 27TF and the upper surface 25U and cylindrical side wall 25S of member 23 engaging the lower wall 27B and the inside cylindrical wall of folded portion 27BF. The inside surfaces of folded portions 27TF and 27BF are fixedly secured to the sides 23S and 25S of members 23 and 25 with a suitable glue or adhesive. A plurality of elongated non-stretchable, flexible tension bands or strips 31 are provided. Each of the bands 31 has an upper end 31U and a lower end 31L which are folded around to engage the upper and lower surfaces 23U and 25L respectively of end members 23 and 25 and are secured thereto by glue or by nails or screws (not shown). In the embodiment shown, three members 31 are provided secured to members 23 and 25 such that adjacent members 31 are spaced 120 degrees apart. The number of members 31 used depends on the size of the device. For example there could be six of the members 31 with adjacent members 31 spaced 60 degrees apart. The members 31 are located on the outside of the bladder 27S. Two flexible hook side strips 41 and 43 are secured around the top and bottom ends of the assembly such that strip 41 is secured around the top ends of strips 31 around the outer side of the folded position 27TF and hence around the side 23S of member 23 and strip 43 is secured around the bottom ends of strips 31, around the outer side of folded portion 27BF and hence around the side 25S of member 25. The strips 41 and 43 have hook fasteners 41H and 43H respectively formed on their outer sides.

A flexible sleeve 51 is provided having "loop" fasteners 51L formed on its outer side. The top and bottom ends 51T and 51B are folded and secured inward such that their loop fasteners 51L face inward and engage the hook fasteners 41L and 43L of members 41 and 43 to secure the sleeve 51 to the strips 41 and 43 and around the assembly including strips 41 and 43, bands 31, bladder sleeve 27S and end member 23 and 25. The bladder 27 has a one way valve 27V for inflating and deflating the bladder. The valve 27V may be of the type used in air mattresses and has an interior one-way flapper valve. The valve 27V is aligned with an aperture 25A formed through member 25 to receive a hose 81 attached to an electric pump 83 operated by an AC power supply 84. The member 25 also has three apertures 25AI for receiving screws 61 which are attached to legs 63.

An electrical lead 65 is provided which extends from a male socket 65M inside of the sleeve 51 and strips 43 and 41, through and aperture 21A1 and upward through an aperture 23A2 formed through member 23 to an female socket 65F. A threaded Tee member 67 is provided which extends through an aperture 21A3 of member 23. The member 67 has threads formed on its stem for allowing another threaded member to be attached thereto for allowing signs, etc. to be attached to the top of the apparatus. A top circular sheet 51TS with loop fasteners 51L is attached to the top of the apparatus 21. It has an aperture 51TA for allowing entrance to the female plug 65F. A cover having hoop fasteners is employed for covering the plug 67F when not in use. If desired the lead 65 and socket 65F at the top may be loose without the lead extending through apertures 21A1 and 21A2.

Figure 1:
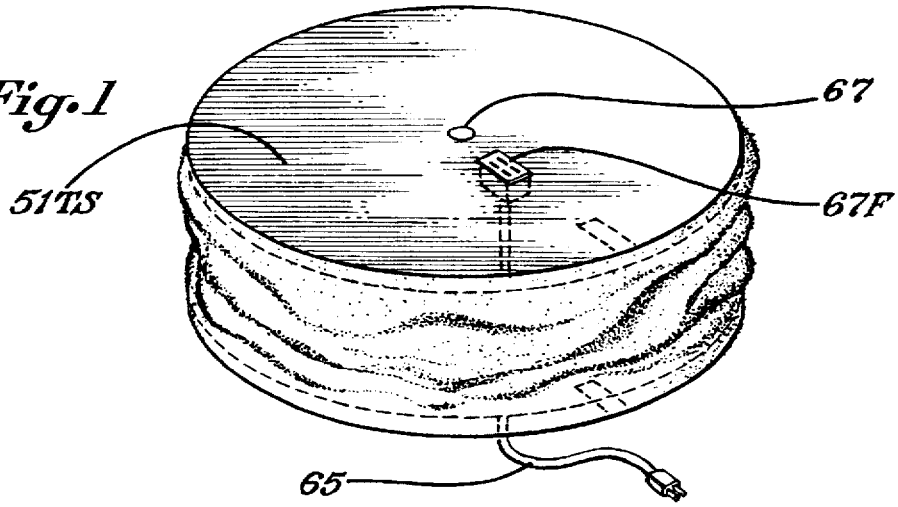
FIG. 1 is a view of the apparatus of the invention in a deflated condition.
Figure 4:
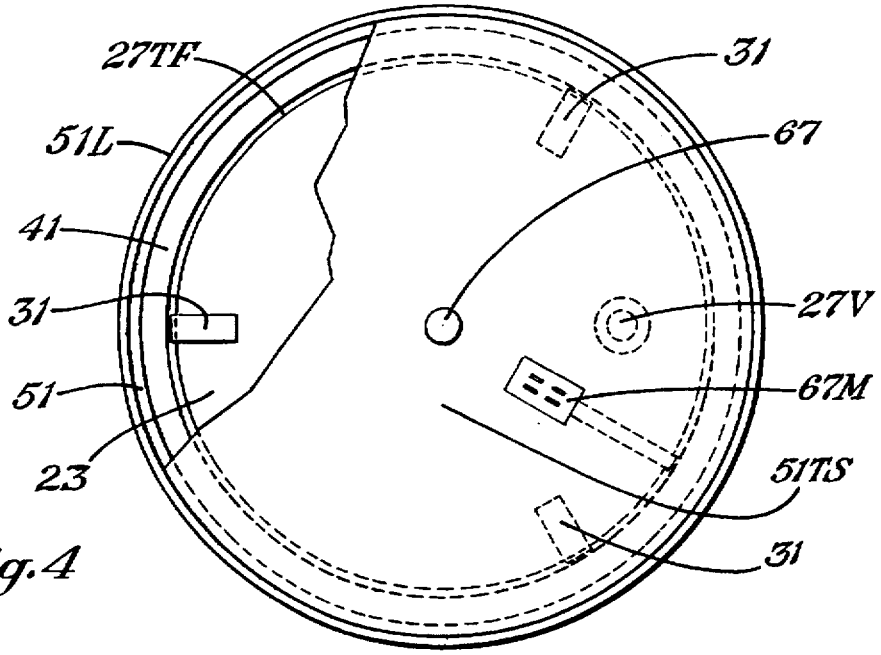
FIG. 4 is a top view of the apparatus of FIGS. 1 and 2.
Figure 3:
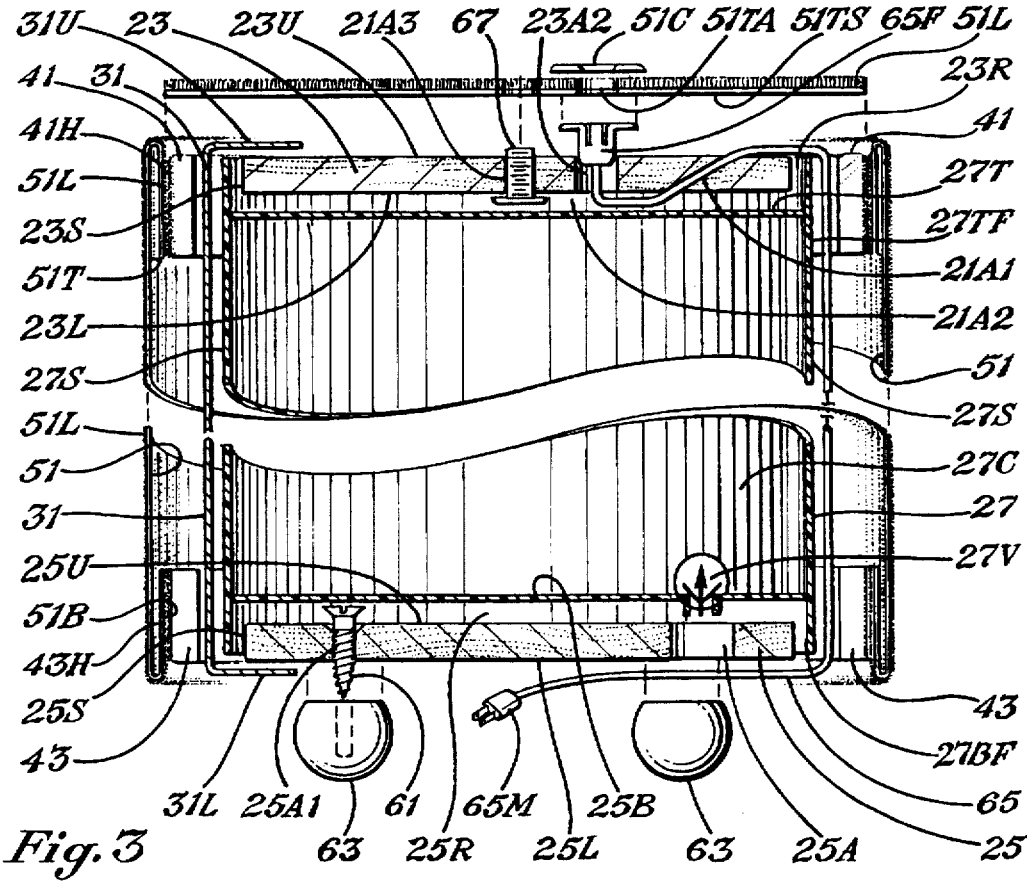
FIG. 3 is a cross-sectional view of the apparatus of FIGS. 1 and 2.

In a storage condition, the bladder 27 is deflated and the bladder wall 27S, strips 31 and sleeve 51 are folded to allow the end members 23 and 27 to be moved close to each other as shown in FIG. 1. This facilitates storage and transport of the member 21. When it is desired to set up the display apparatus 21, the hose 81 is connected to the valve 27 and the pump 83 operated to inject air under pressure into the cavity 27C of the bladder 27. As the bladder inflates, the end wall 23 moves upward away from end wall 25 and the display sleeve 51 expands upward to an extended position as shown in FIGS. 2 and 3. As the end wall 23 moves upward, the tension strips 31 are extended upward. Since the strips 31 are substantially non-stretchable, they limit the upward expansion of the bladder 27 and upward movement of the member 23 and hence prevent damage to the sleeve 51 which may tear if it is stretched too far. The strips 31 also keeps the top and bottom members 23 and 25 in the desired relationship to each other when the bladder is inflated and expanded. Attachment of the top and bottom ends of the sleeve 51 to the members 23 and 25 limit outward radial expansion of the sleeve 51 upon inflation of the bladder. After the bladder 27 has been inflated a desired amount, the hose 81 is removed from the one way valve 27V whereby the apparatus 21 may be used for display purposes. In this respect, products 71 having hooks fasteners 73 attached thereto are easily secured to the sleeve 51 as shown in FIG. 2.

The purpose of the lead 65 is to operate lights which may be carried by a sign attached to Tee 67.

When it is desired to disassemble the apparatus 21, the products 71 are removed from the wall 51, and the flapper valve of the valve 27V pushed inward to allow air in the cavity 27C to be released to deflate the bladder 27 to allow the end members 23 and 27 to be moved toward each other and the bladder wall 27S, strips 31 and sleeve 51 to be folded to place the apparatus in a compact folded condition as shown in FIG. 1.

In one embodiment, the members 23 and 25 each may have an outside diameter of 28 inches. The height of the apparatus 21 with the bladder inflated may be 58 inches. It is to be understood that the apparatus 21 may have other dimensions. The strips 31 may have a width of ½ of an inch. They may be formed of polypropylene having a tensile strength of about 400 pounds per half inch. Under the load imposed herein they will not stretch. The strips 31 also may be formed of other materials such as polyester stranded banding material having a tensile strength of about 2000 pounds per half inch.

The bottom member 25 can be attached to a stand rotated by an electric motor if desired.

Figure 6:
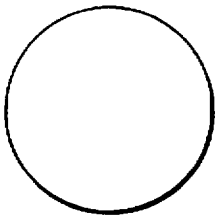
FIGS. 6, 8, 10, 12, and 14 are top views of the apparatus of FIGS. 5, 7, 9, 11, and 13 respectively.
Figure 5:
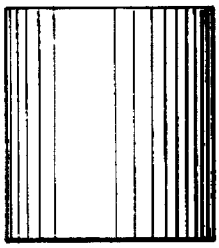
FIGS. 5, 9, 11, and 13 are side views of different shapes of the apparatus of the invention.

The shape of the apparatus of FIGS. 5 and 6 is the same as that of FIGS. 1–4.

Figure 8:
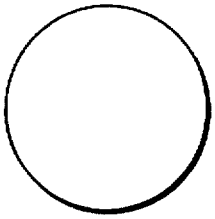
Figure 10:
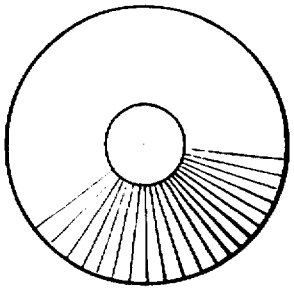
Figure 7:
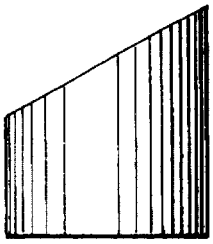
Figure 9:
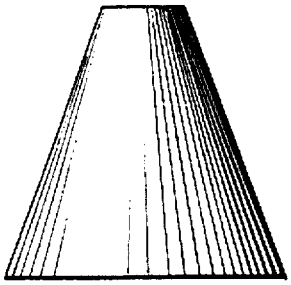
Figure 15:
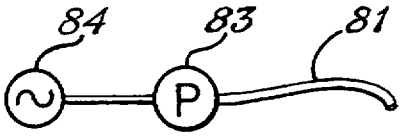
FIG. 15 illustrates a pump and a hose for inflating the bladder of the apparatus of the invention.
Figure 12:
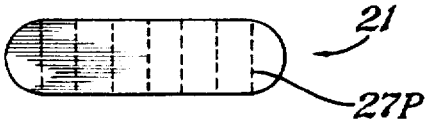
Figure 14:
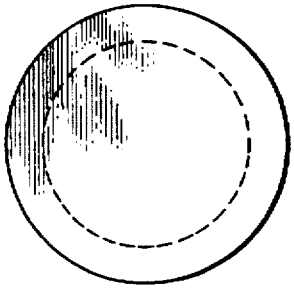
Figure 11:
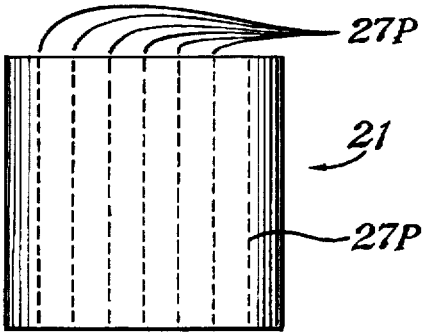
Figure 13:
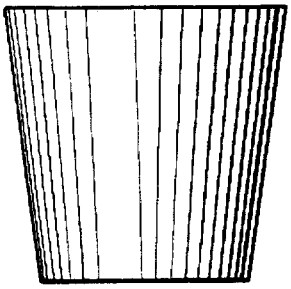

Referring to FIGS. 7–14, the apparatus shown therein employ the basic components of FIGS. 1–4, however, the top and bottom members 23 and 25 of the apparatus are modified to provide the shapes shown. In these Figures, the bladders are in inflated conditions. In FIGS. 7 and 8, the side wall of the apparatus is cylindrical, however, the top wall forms an acute angle relative to the bottom wall. In FIGS. 9 and 10 the apparatus is in the form of a truncated cone with the top wall having a diameter smaller than that of the bottom wall. In FIGS. 13 and 14, the apparatus is in the form of a truncated cone with the top wall having a diameter larger than that of the bottom wall. In FIGS. 11 and 12, the apparatus has two flat sides with rounded ends when viewed from the top and bottom. The bladder has interior partitions 27P with interior passages (not shown) such that it can be inflated from a single valve.

I claim:

1.An inflatable display apparatus, comprising:

top and bottom members each having an upper end, a lower end, and an outer side with said outer sides defining the outer perimeters of said top and bottom members, respectively, an inflatable member formed of elastic material having upper and lower ends attached to said top and bottom members respectively such that said inflatable member forms a cavity between said top and bottom members, a plurality of elongated flexible members each having an upper end coupled to said top member and a lower end coupled to said bottom member, said upper and lower ends of said flexible members being coupled to said top and bottom members respectively at spaced apart positions around said inflatable member, a flexible sleeve having upper and lower ends coupled to said top and bottom members respectively such that said sleeve surrounds said inflatable member and has an outer facing side between said top and bottom members, said inflatable member having an inlet for receiving gas under pressure into said cavity to inflate said inflatable member to move said top and bottom members away from each other to allow said flexible sleeve to be moved to an extended position between said top and bottom members to form an outward facing wall, said flexible sleeve having fastening means of a first type formed on its outer side to allow attachment of fastening means of a second type such that articles having attachment means of said second type may be removably attached to said outer side of said flexible sleeve, said flexible members being characterized such that they limit stretching of said inflatable member between said top and bottom members when inflated, to prevent said flexible sleeve from being damaged when said inflatable member is inflated and said flexible sleeve is moved to said extended position, and the gas injected into said cavity being releasable from said cavity to deflate said inflatable member to allow said top and bottom members to be moved toward each other to a compact storage position.

2. The apparatus of claim 1, wherein:

said flexible members each have an elasticity less than that of the material of said inflatable member.

3. An inflatable display apparatus, comprising:

top and bottom members each having an upper end, a lower end, and an outer side with said outer sides defining the outer perimeters of said top and bottom members, respectively, an inflatable member formed of elastic material having upper and lower ends attached to said outer sides of said top and bottom members respectively such that said upper and lower ends of said inflatable member surround said outer sides of said top and bottom members respectively and said inflatable member forms a cavity between said top and bottom members, a plurality of elongated flexible members each having an upper end coupled to said top member and a lower end coupled to said bottom member, said upper and lower ends of said flexible members being coupled to said top and bottom members respectively at spaced apart positions around said inflatable member, a flexible sleeve having upper and lower ends coupled to said outer sides of said top and bottom members respectively such that said upper and lower ends of said sleeve surround said outer sides of said top and bottom members respectively and said sleeve surrounds said inflatable member, said inflatable member having an inlet for receiving gas under pressure into said cavity to inflate said inflatable member to move said top and bottom members away from each other to allow said flexible sleeve to be moved to an extended position between said top and bottom members to form an outward facing wall, said flexible sleeve having an outer side with fastening means of a first type formed on said outer side to allow attachment of fastening means of a second type such that articles having attachment means of said second type may be removably attached to said outer side of said flexible sleeve, said flexible members being characterized such that they limit stretching of said inflatable member between said top and bottom members when inflated, to prevent said flexible sleeve from being damaged when said inflatable member is inflated and said flexible sleeve is moved to said extended position, and the gas injected into said cavity being releasable from said cavity to deflate said inflatable member to allow said top and bottom members to be moved toward each other to a compact storage position.

4. The apparatus of claim 3, wherein:

said flexible members each have an elasticity less than that of the material of said inflatable member.

* * * * *